US006523951B2

(12) United States Patent
Takeya et al.

(10) Patent No.: US 6,523,951 B2
(45) Date of Patent: Feb. 25, 2003

(54) PRINTING METHOD FOR A PACKAGING, THE PACKAGING, AND PRINTING SYSTEM THEREOF

(75) Inventors: Toshiyuki Takeya, Kanagawa (JP); Hiroshi Seikai, Kanagawa (JP); Masaru Shiino, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/909,990

(22) Filed: Jul. 23, 2001

(65) Prior Publication Data

US 2002/0024577 A1 Feb. 28, 2002

(30) Foreign Application Priority Data

Jul. 21, 2000 (JP) ..... 2000-220154

(51) Int. Cl.[7] ..... B41J 3/407
(52) U.S. Cl. ..... 347/107
(58) Field of Search ..... 347/2, 12, 20, 347/37, 40–43, 107; 358/1.7, 1.12, 1.13; 400/120, 175, 306

(56) References Cited

U.S. PATENT DOCUMENTS 5,146,236 A * 9/1992 Hirata et al. ..... 346/140 R
5,206,490 A * 4/1993 Petigrew et al. ..... 235/462
5,493,107 A * 2/1996 Gupta et al. ..... 235/383
6,151,037 A * 11/2000 Kaufman et al. ..... 347/2
6,332,665 B1 * 12/2001 Mantell et al. ..... 347/37

FOREIGN PATENT DOCUMENTS

JP 8-119239 5/1996 ..... B65B/61/26

* cited by examiner

*Primary Examiner*—Raquel Yvette Gordon
*Assistant Examiner*—An H. Do
(74) *Attorney, Agent, or Firm*—Sughrue Mion, PLLC

(57) ABSTRACT

A printing method for an ink jet printer to print first density information and second dot density information, including arranging a plurality of print heads including two or more first print heads to have a first angular orientation for printing the first information, and at least a second print head to have a second angular orientation, different from the first angular orientation for printing the second information; printing the first information by the first print heads to obtain the first dot density; and printing the second information by the second print head to obtain the second dot density.

21 Claims, 12 Drawing Sheets

PRINTING METHOD FOR A PACKAGING, THE PACKAGING, AND PRINTING SYSTEM THEREOF

This patent application claims priority from a Japanese patent application No. 2000-220154 filed on Jul. 21, 2000, the contents of which are incorporated herein by reference.

BACKGROUND OF THE INVENTION

1. Field of the Invention

The present invention relates to a printing method for a packaging, the packaging, and a printing system thereof. The present invention especially relates to the printing method for the packaging accommodating a product to be distributed through a distribution system, the packaging, and printing system for the packaging on which information about the product is printed and used in the distribution system.

2. Description of the Related Art

A system for color printing on a carton accommodating cassette tapes and so on is conventionally disclosed (Japanese Patent Laying-Open No. Hei. 8-119239). According to the conventional system, a subject copy for color printing is read by a CCD scanner. The scanned subject image is transmitted to a printer unit. The printer unit has an ink jet print head and prints the image according to the transmitted information on the carton. The invention published in Japanese Patent Laying-Open No. Hei. 8-119239 discloses the printing that is preferable for the large item small scale production which applies printing using the ink jet print head as described above.

Information printed on a packaging is various information about the accommodated product. Each part of information requires each different printing condition determined by the contents of information. When more than one of information having different printing conditions are printed on a package at the same time, in most cases, the entire information is printed with the strictest printing condition such that all the demanded printing conditions are satisfied.

Information printed on a packaging often includes a bar code symbol for the dispatch unit code system defined by JIS for distribution. The bar code symbol is recognized by an optical reading apparatus, and processed for distribution. JIS defines PCS (print contrast signal) value, which is a ratio of reflectivity between a printed part and the rest of white part, and printing accuracy of a printed bar code. Conventionally, the bar code symbol has been difficult to print by ink-jet printing apparatus. If dye ink is selected for printing, the printed bar code blots and does not satisfy the required printing accuracy. If thermo plastic ink is selected, a surface of the printed part is glare, so that the reflectivity of the printed part is relatively high; therefore it does not satisfy a certain level of reflectivity. Only pigment ink may satisfy both the reflectivity and printing accuracy required by the dispatch unit code system in a certain condition.

An ink jet print head has a plurality of nozzles, and each of the nozzles ejects an ink droplets. The ink dots strike the surface to be printed and prints dots on the surface. To print the bar code symbol satisfying the reflectivity with pigment ink, the plurality of nozzles have to be provided in such an arrangement that no space is generated between the adjacent ink dots ejected on the printed surface; i.e. dot density of a printed part must satisfy a predetermined value. Otherwise, there would occur white strikes where no ink reaches onto the printed part. The dot density depends on the number of dots in a unit area and the size of each printed dot. The dot size does not depend on a volume of ink at each injection, but rather a distance between the nozzles and the surface of material to be printed. When the distance is increased, the ink dot expands and a gap between dots is filled, however, printing accuracy is not satisfied. If the volume of ink is increased keeping a certain distance the printed bar code symbol is not blotting around, the gaps between nozzles are not filled; therefore the printed bar of the bar code symbol satisfying required conditions cannot be formed.

For printing the bar code symbol in the minimum standard magnification, 0.6 times the standard size defined by JIS, a height of the bar code symbol becomes 26 mm. The print head for ink jet printing using the pigment ink conventionally includes 32 nozzles, and prints a maximum height of 70 mm. If the conventional ink jet print head is tilted for printing information solid-print like style without the undesirable strikes, the print head may print a character or a mark having only a maximum height of 20 mm. Therefore the bar code symbol may not be printed by one print head. If the bar code symbol is divided into two or more parts and printed by more than one print head separately, because the bar code symbol requires high accuracy in alignment; it is difficult to satisfy the required printing accuracy and alignment. Therefore, it is conventionally difficult to print a bar code symbol by the ink jet printing.

Recently, a print head with both high dot density and a long printing length has been developed, therefore an ink jet print head may be used for printing the bar code; however, the print head with high dot density and the larger printing region is relatively expensive.

Moreover, when the entire information is printed in the strictest condition by the ink jet print head, ink consumption unnecessarily increases, therefore a problem such as a printing cost rise and process time increase occurs.

SUMMARY OF THE INVENTION

Therefore, it is an object of the present invention to provide a manufacturing method of a packaging, the packaging, and the printing apparatus, which is capable of overcoming the above drawbacks accompanying the conventional art. The above and other objects can be achieved by combinations described in the independent claims. The dependent claims define further advantageous and exemplary combinations of the present invention.

According to the first aspect of the present invention, a printing method for an ink jet printer to print first dot density information and second dot density information, comprises: arranging a plurality of print heads including two or more first print heads to have a first angular orientation for printing the first information, and at least a second print head to have a second angular orientation, different from the first angular orientation for printing the second information; printing the first information by the first print heads to obtain the first dot density; and printing the second information by the second print head to obtain the second dot density.

The printing methods may further has moving material to be printed in a direction in which the material to be printed is conveyed for printing the material with the first and second information, wherein each of the first print heads has a first angle with respect to the moving direction and the second print head has a second angle with respect to the moving direction, and the first angle is less than the second angle.

The first dot density is finer than the second dot density. The first information may be information recognized by an optical reading apparatus for distribution, and information for the optical reading apparatus is printed by the first print heads in the first dot density that reflectivity in a printed part, which is printed by the first print heads, satisfies a predetermined value required by the optical reading apparatus.

A plurality of nozzles for ejecting ink droplets included in the first print heads may be arranged in the first angle with respect to a direction in which a material to be printed is conveyed, and the first print heads print information for the optical reading apparatus at such reflectivity in a printed part printed by the first print heads that exceeds a predetermined value required by the optical reading apparatus.

The second information may be observed information, visually indicating type of a product accommodated in a package for a distribution on which the second and first information is printed, recognized by a person handling the packaging in the distribution, and the observed information is printed by the second print head, a plurality of nozzles included in the second print head is provided at the second angle for printing the observed information in a larger size than the first information.

Information for the optical reading apparatus may be divided into more than one regions in the direction perpendicular to a direction in which a material to be printed is conveyed, and each of the regions are printed by respective print head included in the first print heads.

Information for the optical reading apparatus may be a bar code symbol for a dispatch unit code system, the bar code symbol for the dispatch unit code system is divided into a bar code region including a bar code of the bar code symbol and a non-bar code region not including the bar code, and one of the first print heads prints the bar code region and another one of the first print heads prints the non-bar code region separately.

A bearer bar of a bar code symbol for a dispatch unit code may be previously solid-printed on a material the first information and the second information is printed on, information for the optical reading apparatus is a bar code included in the bar code symbol, and at least one of the first print heads prints, arranging the first print head is a position for printing the bar code, the bar code in the bearer bar.

According to the second aspect of the present invention, a printing method for an ink-jet printer, comprises: counting quantity of packaging being printed, acquiring a quantity symbol image corresponding to the quantity thus counted, acquiring a product information image providing information about the product accommodated in the packaging, super imposing the quantity symbol image and the product information image for generating an printing image to be printed on the packaging, and printing the printing image on the packaging using an ink jet print head.

According to the third aspect of the present invention, a printing method for an ink jet printer, printing a bar code symbol for a dispatch unit code of a product on a packaging for distribution of the product, comprises dividing the bar code symbol into a bar code region including a bar code of the bar code symbol and a non-bar code region not including the bar code of the bar code symbol, and printing the bar code region and the non-bar code region separately using respective print heads.

The printing method for an ink-jet printer may further has initially solid-printing a bearer bar of the bar code symbol on the packaging, and after the solid printing, printing a bar code of the bar code symbol in the bearer bar.

According to the fourth aspect of the present invention, a packaging for accommodating for distribution of a product, comprises: information about the product for distribution printed on the packaging, information being divided into first information and second information, wherein the first information is printed in a first dot density by a plurality of first ink jet print heads, and the second information is printed in a second dot density by at least a second ink jet print head.

The first information may be information recognized by the optical reading apparatus for distribution, and information for the optical reading apparatus is printed in a predetermined dot density for satisfying reflectivity of a printed part, the reflectivity exceeding a predetermined value required by the optical reading apparatus.

According to the fifth aspect of the present invention, a packaging for accommodating a product for distribution, comprises: a bar code symbol of a dispatch unit code printed on the packaging, the bar code symbol having a bar code region including a bar code of the bar code symbol and a non-bar code region including the rest of the bar code symbol other than the bar code region, wherein: the bar code region and the non-bar code region are separately printed by respective ink-jet print heads. The packaging for accommodating a product may further has a previously solid-printed bearer bar.

According to the sixth aspect of the present invention, a printing system for ink jet printing, comprises: a plurality of first ink jet print heads for printing first information on material moved in a direction, each of the first print heads having a plurality of nozzles to have a first angle with respect to the moving direction for printing a predetermined dot density for being recognized by an optical reading apparatus for distribution; and a second ink jet print head for printing second information in a larger size than the first information, having a plurality of nozzles arranged to have a second angle with respect to the moving direction, different from the first angle.

At least one of the first angle and the second angle may be adjustable for adjusting positions of the first information and the second information on a material to be printed for adjusting a position on a material to be printed of a bar code symbol for a dispatch unit code. Each of the first ink jet print heads and the second ink jet print head may be structurally the same. Each of the first ink jet print heads and the second ink jet print head may include a same number of ink jet nozzles. The dot density may satisfy a condition that reflectivity in a printed part, which is printed by the first ink jet print heads, exceeds a predetermined value required by an optical reading apparatus for distribution.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

The invention will now be described based on the preferred embodiments, which do not intend to limit the scope of the present invention, but exemplify the invention. All of the features and the combinations thereof described in the embodiments are not necessarily essential to the invention.

Figure 1:
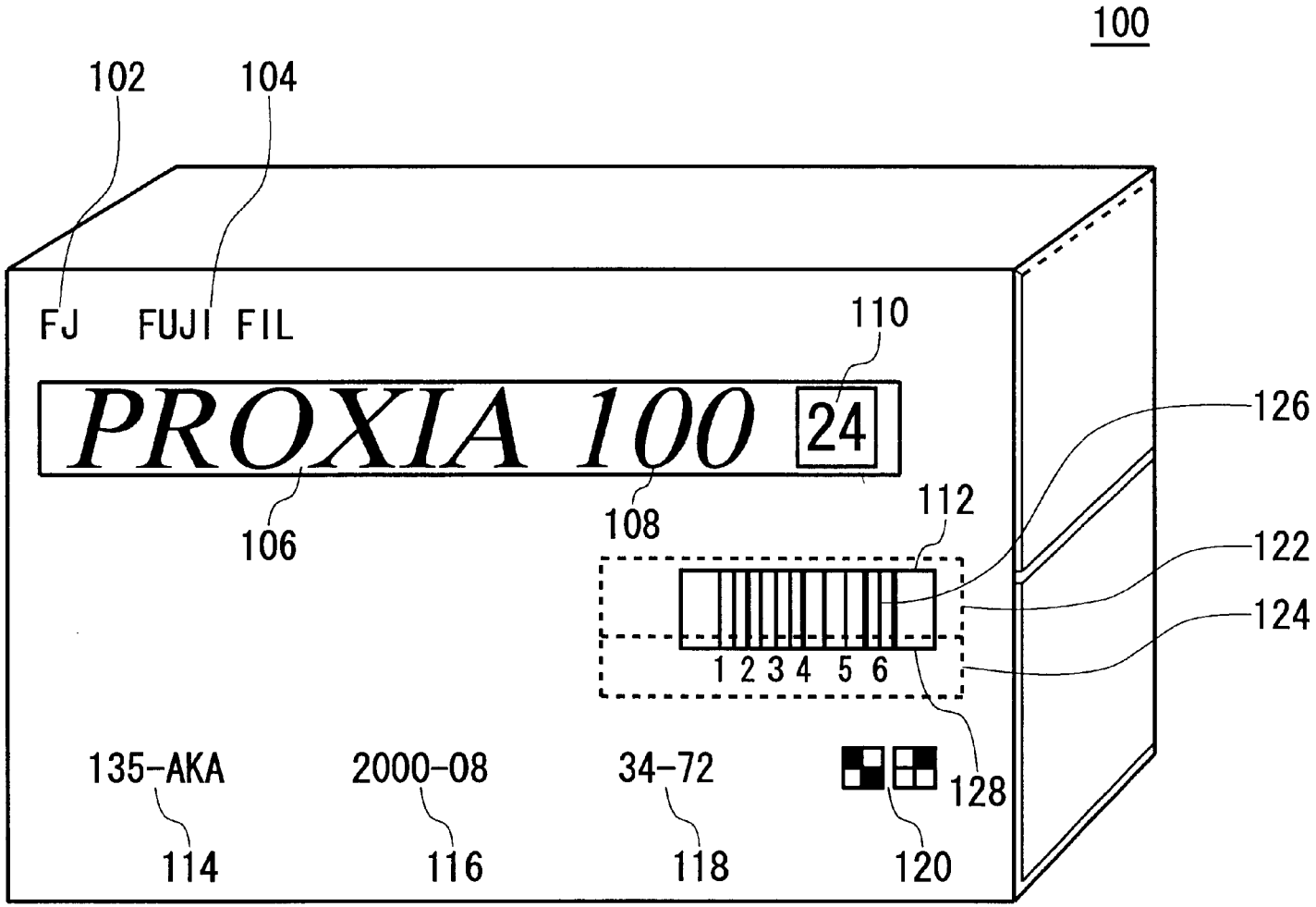
FIG. 1 is a perspective figure of an example of a corrugated fiberboard container with information printed in the present embodiment.

FIG. 1 is a perspective figure of an example of a corrugated fiberboard container with information printed in the present embodiment. The corrugated fiberboard container 100 is an example of a packaging accommodating a product distributed through a distribution system using a dispatch unit code. In the present embodiment, the corrugated fiberboard container 100 accommodates 35 mm negative films for a single lens reflex camera and so on. Information about the accommodated product for distribution is printed outside the corrugated fiberboard container 100. In the description of the present embodiment, a case that printing on only one side of the corrugated fiberboard container is described for convenience of explanation. However, it does not intend to limit the position and the number of the sides to which the printing is applied. Therefore, any number of sides more than one may be applied using the same type of printing as described in the present embodiment.

The following information is printed on the corrugated fiberboard container 100.

(1) A symbol mark 102 and a name of the manufacturer 104 of the accommodated product.

The symbol mark 102 and the name of the manufacturer 104 are printed on all the corrugated fiberboard containers in common regardless of the kinds of accommodating products. In the present embodiment, information is previously solid-printed on the corrugated fiberboard container 100 using the public known offset printing. Other than the symbol mark 102 and the name of the manufacturer 104, for example, a term showing a type of the film such as "negative films" may also be previously solid-printed on the corrugated fiberboard container 100; because the term "negative films" is, even number of prints and speed of the films differ so that the name of the products are different, printed on all the corrugated fiberboard containers 100 in common as long as the corrugated fiberboard containers 100 accommodate the negative film.

(2) A name of the product 106, speed of the film 108, and a number of prints 110.

Information is information to specify the products accommodated in the corrugated fiberboard container (hereafter referred to as "product specifying information"). In the present embodiment, the product specifying information is printed on the corrugated fiberboard container 100 using an ink jet print head. The product specifying information, i.e. observed information, is printed in a larger size character than the rest of information, so that the person handling the corrugated fiberboard container 100 in the distribution system may recognize information, for example, from afar in a warehouse.

(3) A bar code symbol for the dispatch unit code system (hereafter referred to as "the bar code symbol") 112 defined by JIS X0502 1994.

In the present embodiment, the bar code symbol 112 is also printed by the ink jet print head. The bar code symbol 112 is printed 0.625 times the standard size defined by JIS and satisfying the optical characteristics defined by JIS. In the present embodiment, these information is printed by a plurality of print heads structurally the same as the print heads for printing information the name of the product 106, speed of the film 108, the number of prints 110, the abbreviation of the name of the product 114, the expiration date 116, the emulsion number 118, and the additional number 120.

(4) An abbreviation of the name of the product 114, an expiration date 116, an emulsion number 118, and an additional number 120.

The abbreviation 114 is an abbreviated name assigned for each of the products to specify the product accommodated in the corrugated fiberboard container 100 defined by the manufacturer. The expiration date 116 is a due date informing when quality of the film accommodated in the corrugated fiberboard container 100 is assured to be above a predetermined level. The emulsion number 118 is a manufacturing lot number of the emulsion used for manufacturing the film accommodated in the corrugated fiberboard container 100. The additional number 120, i.e. a quantity, is a serial number allocated to the corrugated fiberboard containers which have the same emulsion number. In the present embodiment, the additional number 120 is printed using a hexadecimal symbol that the manufacturer especially designed for this purpose. In the present embodiment, the abbreviation 114, the expiration date 116, the emulsion number 118, and the additional number 120 are also printed by the ink jet print head.

Information included in the bar code symbol 112 is the first information and is printed in first dot density. Information is recognized by an optical reading apparatus, and notified as information for the optical reading apparatus. Information included in the name of the product 106, speed of the film 108, the number of prints 110, the abbreviation of the name of the product 114, the expiration date 116, the emulsion number 118, and the additional number 120 is observed information and printed in second dot density. Information for the optical reading apparatus is finer in the dot density than the observed information.

Figure 2:
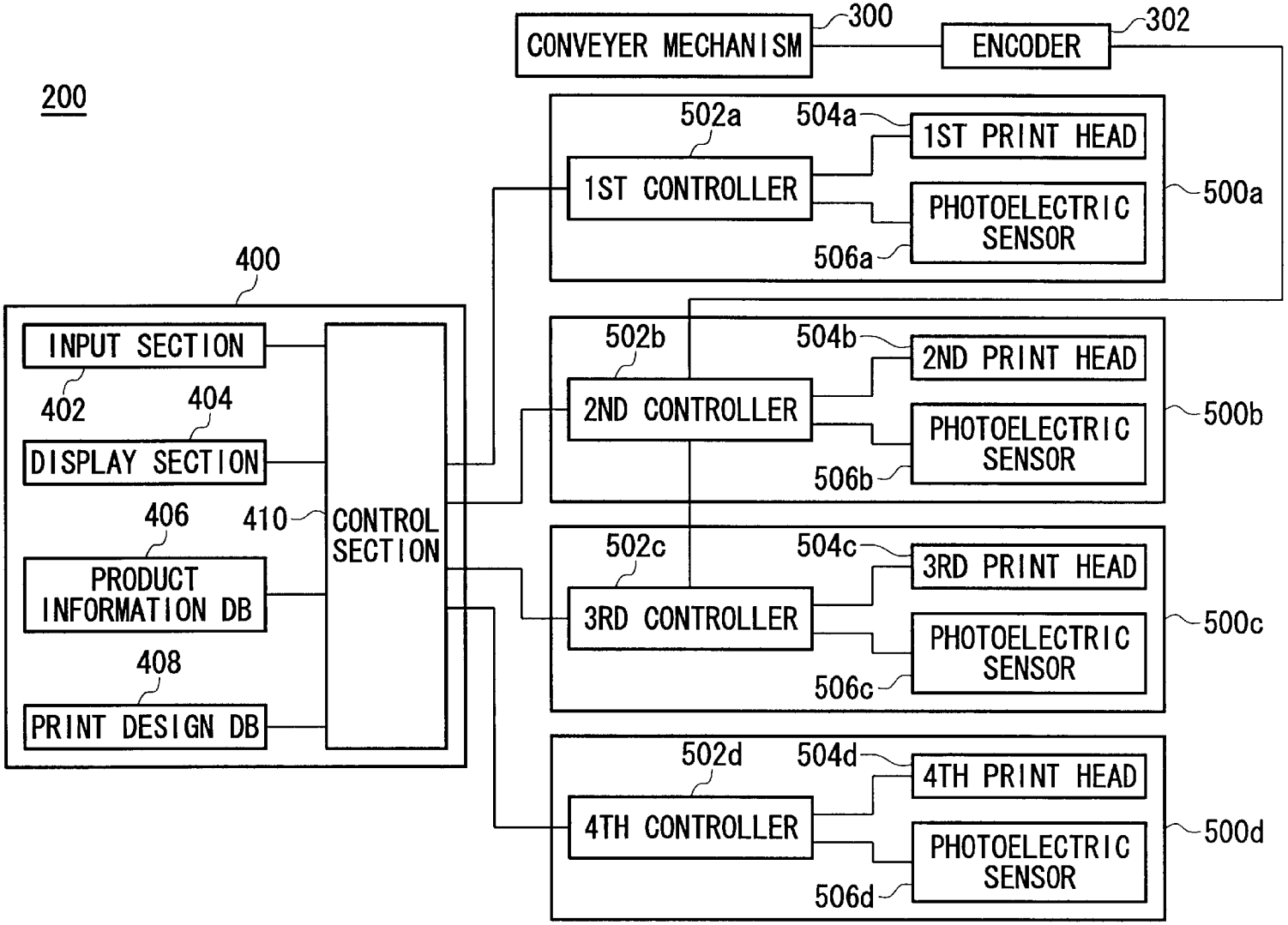
FIG. 2 is a block diagram showing the function of the printing system applying the present embodiment for printing information.

FIG. 2 is a block diagram showing the function of the printing system applying the present embodiment for printing the above described information such as the name of the product 106, speed of the film 108, the number of prints 110, the abbreviation of the name of the product 114, the expiration date 116, the emulsion number 118, and the additional number 120 on the corrugated fiberboard container.

The printing system 200 according to the present embodiment has a conveyer mechanism 300, from a first printing apparatus 500*a* through a fourth printing apparatus 500*d*, and a printing control computer 400.

The conveyer mechanism 300 conveys the corrugated fiberboard container 100 using a public known belt conveyer. The conveyer mechanism 300 has an encoder 302 which detects distance moved by the belt conveyer. The detailed construction of the conveyer mechanism 300 will be described in following with referring FIG. 3.

The printing control computer 400 has a control section 410 for controlling the plurality of printing apparatuses from 500*a* through 500*d*, an input section 402 for inputting various information to the control section 410, and a display section 404 for displaying information from the control section 410. The printing control computer 400 further has a printing design database 408 and a product information database 406 storing information to be printed on the corrugated fiberboard container 100.

The product information database 406 stores following information which is related one another:

(1) a product code, a unique code number allocated for each products, (2) an IPP code, a code number having an one-to-one correspondence to the product code, (3) an abbreviation of the product, specified by the product code, (4) a fiberboard container code, a unique code number for each type of corrugated fiberboard container accommodating the product specified by the product code, (5) an abbreviation of the corrugated fiberboard container, specified by the fiberboard container code, and (6) a dispatch unit Product Code of the product, specified by the product code.

The printing design database 408 stores following information which is related one another:

(1) the IPP code, (2) a bit map data BMP1 indicating the image of information previously solid-printed on the corrugated fiberboard container such as the symbol mark and the name of the manufacturer, and (3) a bit map data BMP2 indicating the image of the product specifying information to be printed on the corrugated fiberboard.

The printing apparatuses 500, that is from the first printing apparatus 500*a* through the fourth printing apparatus 500*d*, print information sent from the printing control computer 400 on the corrugated fiberboard container 100 conveyed by the conveyer mechanism 300. Each of the printing apparatuses 500 has an ink jet print head 504 and a photoelectric sensor 506 optically detecting that the corrugated fiberboard container 100 conveyed by the conveyer mechanism 300 arrives a predetermined position to the print head 504. Each of the printing apparatuses 500 further has a controller 502 for connecting with the print head 504 and the photoelectric sensor 506, and the controller 502 controlling the print head 504 for printing.

The second controller 502*b* included in the second printing apparatus 500*b* is also connected to the encoder 302. An output signal from the encoder 302 is inputted to the controller 502*b*. Furthermore, the controller 502*b* in the second printing apparatus 500*b* is connected with the controller 502*c* in the third printing apparatus 500*c*. An output signal outputted from the photoelectric sensor 506*b* is transmitted to the controller 502*c*.

Figure 3A:
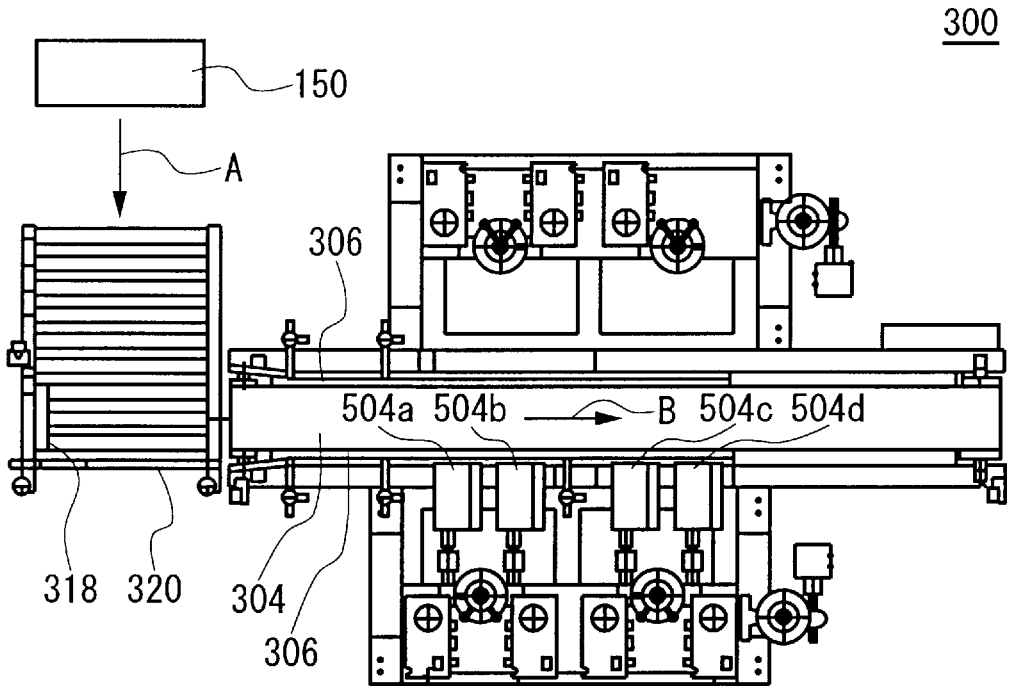
FIG. 3A is an upper view of a printing system including a conveyer mechanism.
Figure 3B:
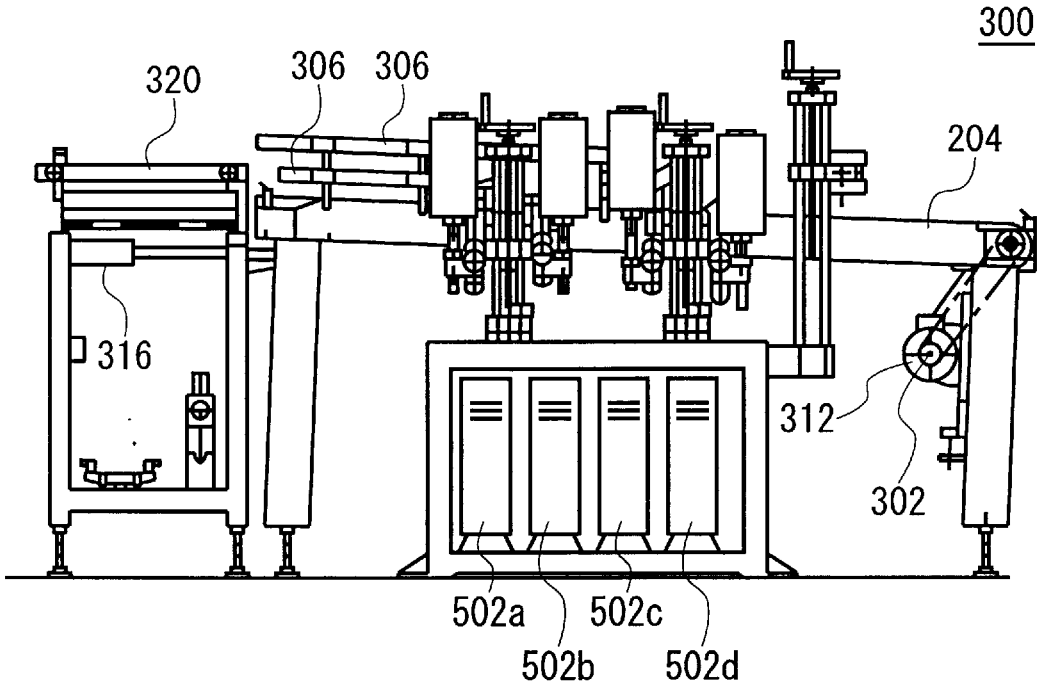
FIG. 3B shows a side view of a printing system including a conveyer mechanism.

FIG. 3 is an upper view FIG. 3A and a side view FIG. 3B of the printing system including the conveyer mechanism.

The conveyer mechanism 300 includes a lead-in 320, where the corrugated fiberboard container 100 to be printed is led in, and a belt conveyer 304 for conveying the corrugated fiberboard container 100. The lead-in 320 includes a pusher 318 driven by an air cylinder 316 for pushing the corrugated fiberboard container 100 onto the belt conveyer 304. A guide 306 is provided on each side of the belt conveyer 304. The guide 306 sets up the position of the corrugated fiberboard container 100 for a crosswise direction on the belt conveyer 304. The crosswise direction is defined such as a direction perpendicular to the movement of the belt conveyer 304 and is included in a horizontal plane.

On one side of the belt conveyer 304, the print heads from the first print head 504*a* through the fourth print head 504*d* are provided. Under the belt conveyer 304, the controllers from the first controller 502*a* through the fourth the controller 504*d* corresponding to each of the print heads from 504*a* through 504*d* are provided.

The belt conveyer 304 includes a motor 312 for a driving source. On a shaft of the motor 312, the encoder 302, already mentioned, is connected.

Applying the conveyer mechanism 300, the corrugated fiberboard container 100 is inserted to the lead-in 320 in the direction of arrow A shown in the figure. The inserted corrugated fiberboard container 100 is moved to the belt conveyer entrance. When the inserted corrugated fiberboard container 100 arrives at a predetermined position and the pusher 318 is activated, the corrugated fiberboard container 100 is pushed onto the belt conveyer 304. The belt conveyer 304 carries the corrugated fiberboard container 100 in the direction of arrow B shown in the figure. The direction of arrow B is a direction in which material to be printed is conveyed. Here, the guide 306 guides the corrugated fiberboard container 100 so that the distance between the print heads 504 and the surface of the corrugated fiberboard container 100 is kept in a predetermined distance appropriate for ink jet printing. When the corrugated fiberboard container 100 passes the side of the print heads from 504*a* through 504*d*, information is printed on the side of the corrugated fiberboard container 100.

Figure 4:
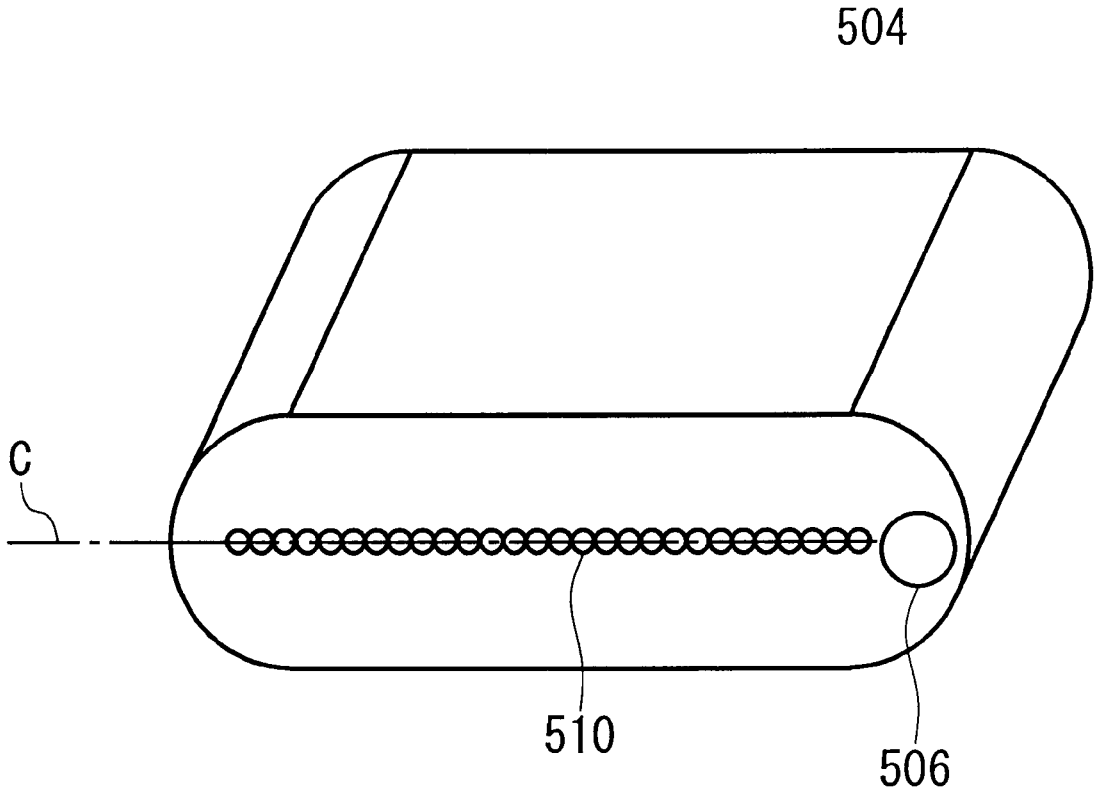
FIG. 4 is a perspective view showing one of print heads.

FIG. 4 is a perspective view showing any one of the print heads 504. The print head 504 has a plurality of ink ejecting nozzles 510 and a photoelectric sensor 506 on a side facing to the corrugated fiberboard container 100. Applying the present invention, all the print heads are structurally the same; therefore each print head has a same number of nozzles. The nozzles 510 for ejecting ink droplets are provided such that the center of each of the nozzles is arranged along a predetermined straight line C (the direction parallel to the straight line C will be mentioned "the nozzle array direction" thereafter). The photoelectric sensor 506 includes a light emitting element for emitting light forward the print head 504 to the corrugated fiberboard container 100 and a light receiving element for detecting the reflection of the emitted light. The photoelectric sensor 506 detects, from the strength of the reflection detected by the light receiving element, that the corrugated fiberboard container 100 is conveyed in front of the print head 504. Here, the nozzles are provided on line C; however, as long as intervals of the nozzles projected on the vertical plane are constant, the arrangement of the nozzles is not limited to the above described arrangement but such an arrangement may be arranged on more than one line and so on.

Figure 5:
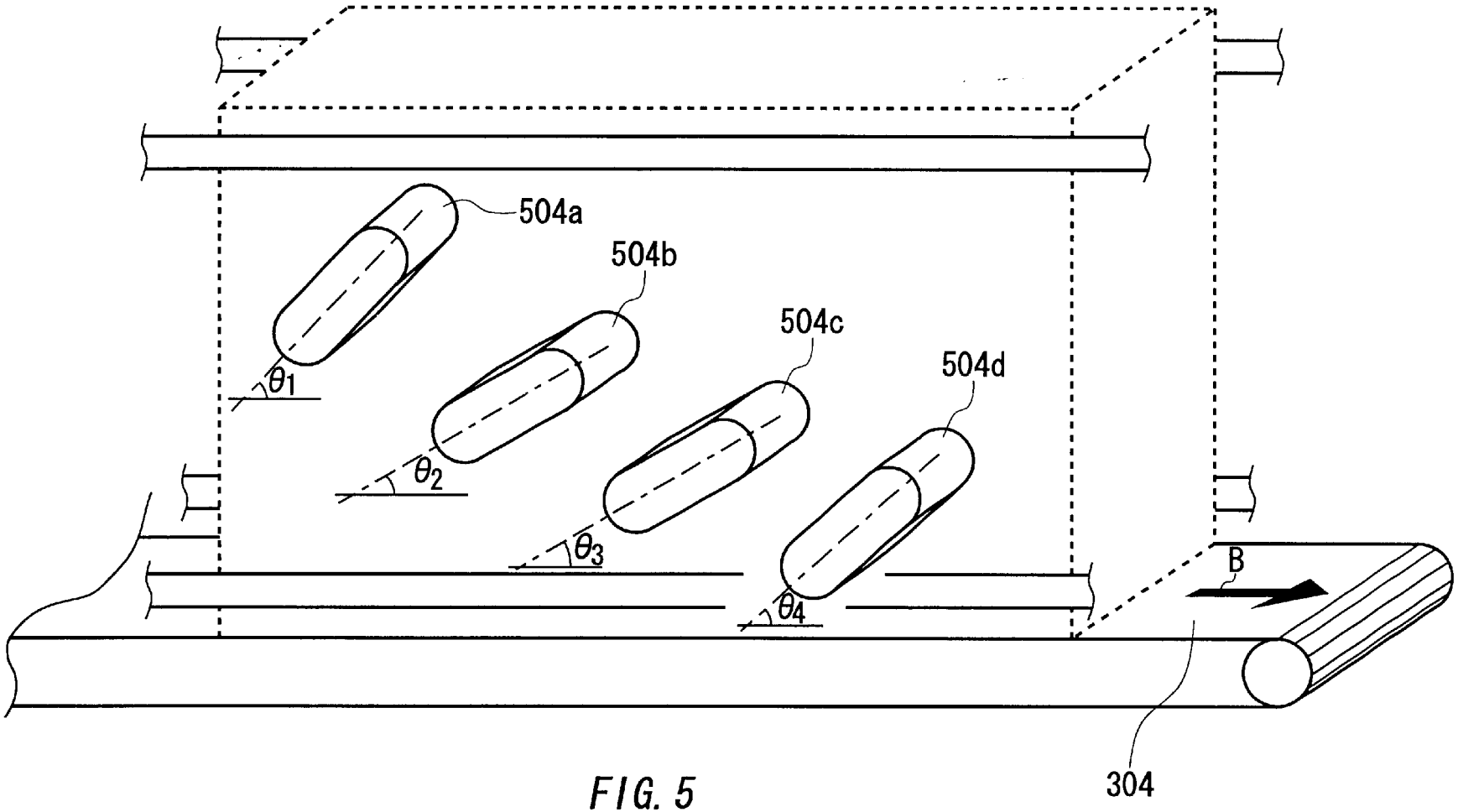
FIG. 5 is an explanatory figure showing the positions of the print heads from the first print head through the fourth print head.

FIG. 5 is an explanatory figure showing the positions where the print heads from the first print head 504*a* through the fourth print head 504*d* are provided. Each of the four print heads from 504*a* through 504*d* is set tilted in the direction of arrow B as shown in the figure. Ejecting faces of the nozzles included in the four print heads from 504*a* through 504*d* are set on a plane perpendicular with respect to the surface of the belt conveyer 304 and including the moving direction of the belt conveyer (the direction of arrow B as shown in the figure).

An angle of each of the nozzle array direction of the print heads with respect to a moving direction of the corrugated cardboard container, which is described with doted lines in FIG. 5, is defined as from θ1 through θ4. In the present embodiment, each of the angles is described with the relation such that $0° < \theta 2 < \theta 1 < 90°$, and $\theta 1 = \theta 4$ and $\theta 2 = \theta 3$. That is, the second print head 504*b* and the third print head 504*c* are set in the smaller angle than the first print head 504*a* and the fourth print head 504*d* to the conveyer's moving direction. Therefore, the second print head 504*b* and the third print head 504*c* has high dot density than the first print head 504*a* and the fourth print head 504*d*, so that may print information in more solid-print like style. That is, a first angle of first print heads for printing first information, as information for an optical reading apparatus, is less than a second angle of at least a second print head for printing second information. On the other hand, the first print head 504*a* and the fourth print head 504*d* may print larger size characters for the observed information than the second print head 504*b* and the third print head 504*c* for information for the optical reading apparatus.

Each of the print heads from the first print head 504*a* through the fourth print head 504*d* is positioned on the different height from the surface of the conveyer so that prints on the different region on the corrugated fiberboard container 100. That is, the print head 504*a* is set in the highest position, the second print head 504*b*, the third print head 504*c*, and the fourth print head 504*d* are set in positions sequentially lowered.

Figure 6A:
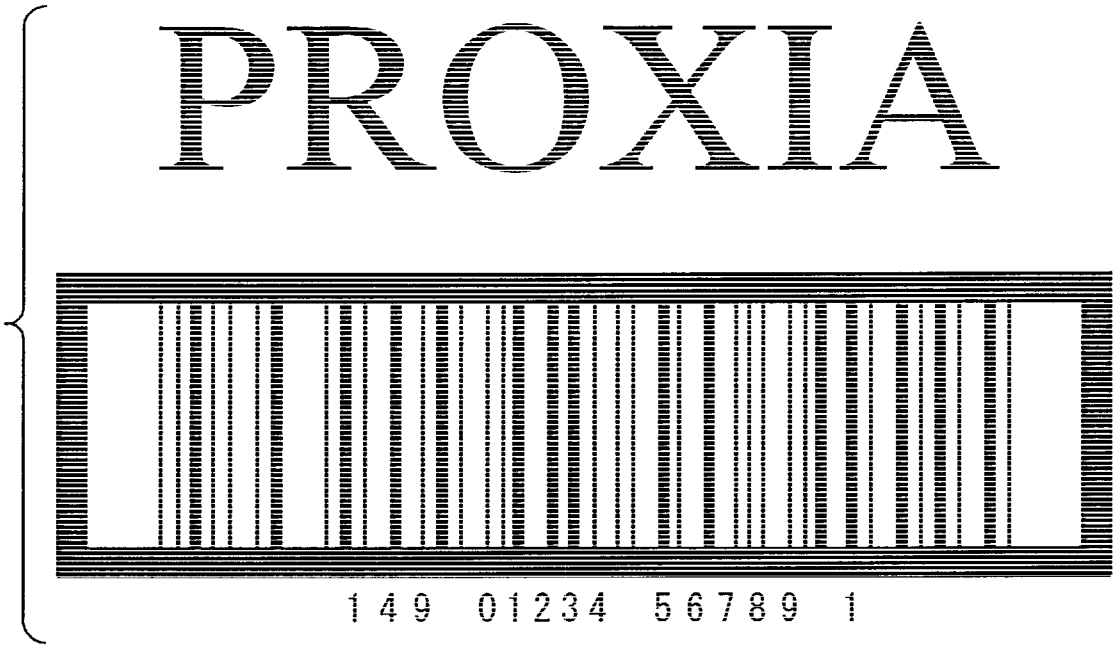
FIG. 6A shows examples of characters and a bar code printed on the corrugated fiberboard container by the first print head or the fourth print head.
Figure 6B:
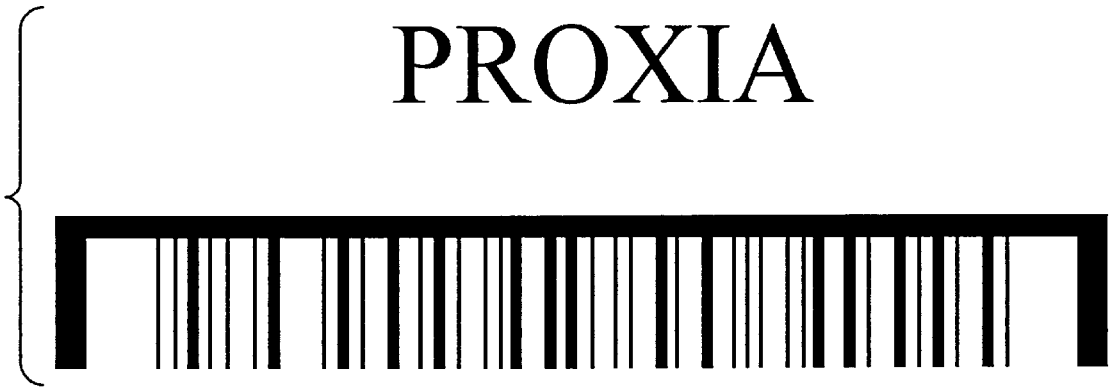
FIG. 6B shows examples of characters and a part of a bar code printed on the corrugated fiberboard container by the second print head or the third print head.

FIG. 6 shows examples of characters and bar codes printed on the corrugated fiberboard container 100. FIG. 6A shows an example of characters and a bar code printed by the first print head 504*a* and the fourth print head 504*d* (a). FIG. 6B shows an example of characters and a bar code printed by the second print head 504*b* and the third print head 504*c* (b).

As shown in FIG. 6A, the first print head 504*a* and the fourth print head 504*d* may print the larger size characters, which is for the observed information, than the second print head 504*b* and the third print head 504*c*. In the present embodiment, the print heads print the characters in maximum 30 mm height. The characters in 30 mm size are, because the characters in 30 mm size may be clearly recognized by a worker in the warehouse from a distance for the larger sized characters, preferable for the characters printed on, for example, the corrugated fiberboard container stacked in a warehouse. On the other hand, the dot density of the printed characters is low, and the white part where the ink is not printed is left as white strikes on the characters. Therefore, the printed part of the characters is printed in relatively high reflectance. As a result, for the bar code symbol printed by the first print head 504*a* and the fourth print head 504*d*, a PCS value defined by JIS X0502 1994 does not exceed 75%. That is, the first print head 504*a* and the fourth print head 504*d* are not able to print the bar code symbol satisfying the JIS.

On the contrary, the second print head 504*b* and the third print head 504*c* may execute, as shown in FIG. 6B, so-called solid-like printing with finer dot density. Therefore, the bar code symbol satisfying the optical characteristic defined by JIS (the PCS value is 75% or more) may be printed by the second print head 504*b* and the third print head 504*c*. The second print head 504*b* and the third print head 504*c* are provided more tilted to the direction in which the material to be printed is conveyed such that the angle θ2 and θ3 becomes smaller, therefore may not print the characters in larger size which has the height. Information printed by the second print head 504*b* and the third print head 504*c* may be recognized by an optical reading apparatus as the bar code symbol for a dispatch unit code system, because the dot density of the printed part satisfies a predetermined value required by the second print head 504*b* and the third print head 504*c*.

Figure 7:
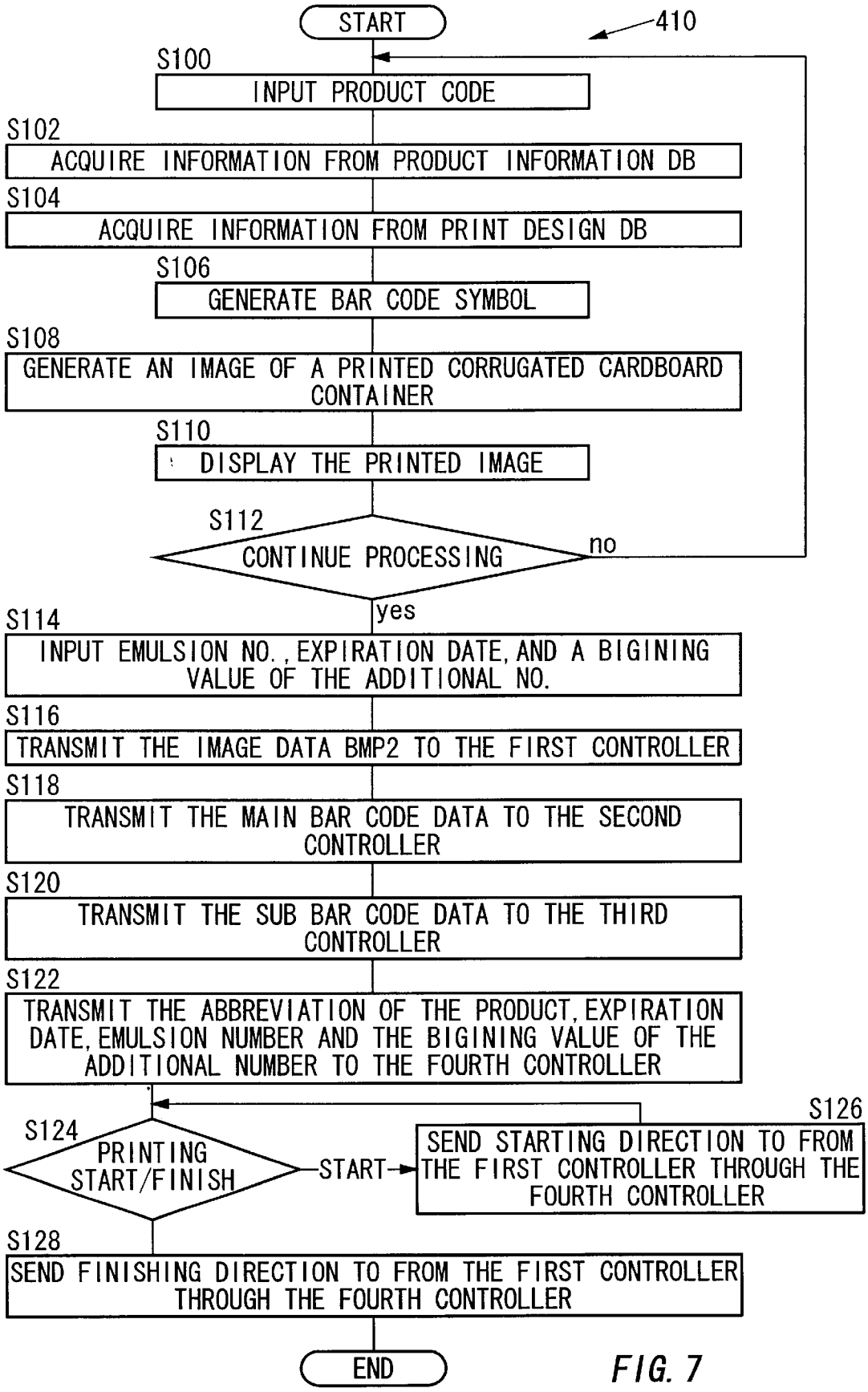
FIG. 7 is a flow chart showing the process executed by the control section when the printing system executes printing.

FIG. 7 is a flow chart showing the process executed by the control section 410 when the printing system 200 executes printing.

Applying the present embodiment, first, the product code of the product accommodated in the corrugated fiberboard container 100 is inputted to the control section 410 via the input section 402 (step 100). The control section 410 inputted the product code acquires from the product information database 406 the IPP code, the abbreviation of the product, the fiberboard container code, the abbreviation of the corrugated fiberboard container, and the dispatch unit code. The above listed information is corresponded to the inputted product code (step 102). The control section 410 also obtains from the printing design database 408 the bit map data BMP1 and BMP2 corresponded with the IPP code acquired in the step 102 (step 104).

The control section 410 generates the bar code symbol corresponding to the dispatch unit code acquired in step 102 (step 106). Then, the control section 410 superimposes images obtained from the bit map data BMP1 and BMP2 in step 104 and the image of the bar code symbol acquired in step 106, and generates an virtual image of the corrugated fiberboard container after the printing is executed (step 108). Furthermore, the control section 410 displays on the display section 404 the virtual image of the corrugated fiberboard container after the printing is executed instep 108 (step 110). Thus, the operator of the printing control computer 400 may confirm the image of the printed corrugated fiberboard container before the printing is actually executed. The control section 410 also displays on the display section 404 the product code, the abbreviation of the product, the fiberboard container code, and the abbreviation of the corrugated fiberboard container (step 110). Watching information, the operator may ensure, by checking the product code displayed on the display section 404, if information of the correct product is going to be printed on the correct corrugated fiberboard container.

Next, an order whether the processing is continued is inputted to the control section 410 via the input section 402 (step 112). The operator of the printing control computer 400 inputs to the input section 402 that the processing is not going to be continued, when the image to be printed and shown in the step 110 is not the desired image. In such case, the processing of the control section 410 goes back to the step 100. On the other hand, the operator inputs, when the image to be printed shown in step 110 is the desired image, to the input section 402 that the processing is going to be continued, and the processing of the control section 410 proceeds to the step 114.

In the step 114, the control section 410 is assigned a beginning value of the additional number, the emulsion number, and the expiration date via the input section 402. Next, the control section 410 transmits to the first controller 502*a* the bit map data BMP2, which is the image data of the product specifying information (step 116). The control section 410 also transmits to the second controller 502*b* an image data of a bar code region including a bar code in the bar code symbol generated in the step 106 (aforementioned "main bar code image data") (step 118). For the main bar code image data, in the present embodiment, image data of the bar codes, an upper horizontal bearer bar, and vertical bearer bars is transmitted. The bar codes, the upper horizontal bearer bar, and the vertical bearer bars construct a bar code region of a bar code symbol.

The control section 410 also transmits to the third controller 502*c* an image data of the rest of the barcode symbol which is not included in the image data transmitted to the second controller (aforementioned"sub bar code image data"). The region including the rest of the bar code symbol is notified to as a non-bar code region (step 120). For the sub bar code image data, in the present embodiment, image data of a lower horizontal bearer bar and indices showing the number is transmitted. The lower horizontal bearer bar and indices, that is the rest of the bar code symbol other than the bar code region, construct a non-bar code region of the bar code symbol.

Furthermore, the control section 410 transmits to the fourth controller 502*d* the abbreviation of the product, the expiration date, the emulsion number, and the beginning value of the additional number (step 122).

The control section 410 supplies the data for printing to each of the controllers from 502*a* through 502*d* by executing the above described processing.

Next, the control section 410 prompts, according to the order of the operator via the input section 402, each of the controllers to start printing (step 124, step 126). The control section 410 prompts, according to the order of the operator via the input section 402, each of the controllers to finish printing (step 124, step 128), and finish the entire series of processing.

Figure 8:
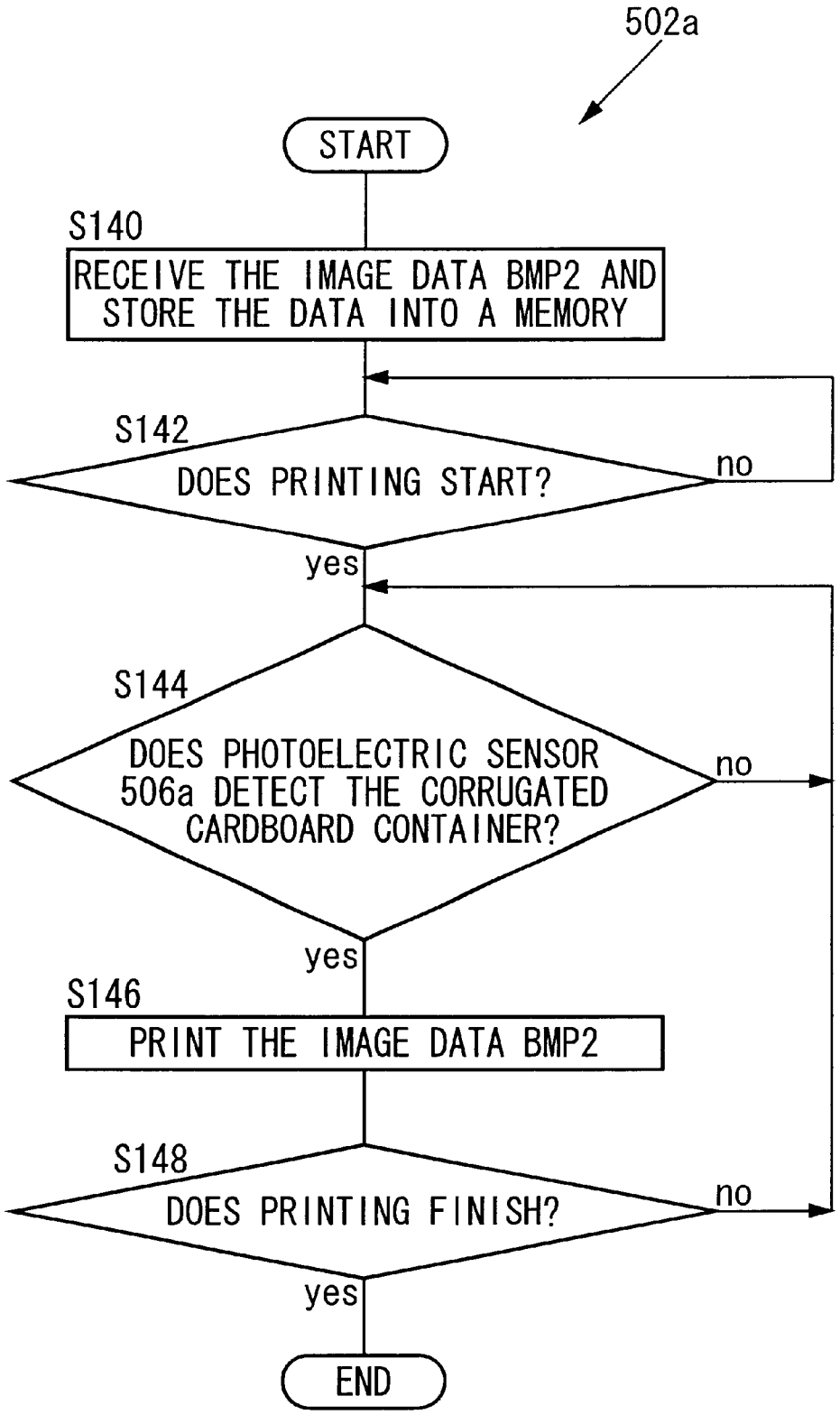
FIG. 8 is a flow chart showing the processing executed by the first controller when the printing system executes printing.

FIG. 8 is a flow chart showing the processing executed by the first controller 502*a* when the printing system 200 executes printing.

The first controller 502*a* obtains, as described in FIG. 7, from the printing control computer 400 the bit map data BMP2which is the image data of the product specifying information (step 140). Next, the first controller 502*a* waits for an order of the start of printing transmitted from the printing control computer 400 (step 142). When the order is sent, the first controller 502*a* watches if the photoelectric sensor 506*a* detects the corrugated fiberboard container 100 (step 144). When an output signal from the photoelectric sensor 506*a* showing the corrugated fiberboard container 100 is detected, the first controller 502*a* executes printing the bit map data BMP2. That is, the first controller 502*a* prompts, calculating the distance of the movement of the belt conveyer 304 using an internal clock, the first print head 504*a* to print the bit map data BMP2 (step 146). The first controller 502*a* continues the processing the step 144 and the step 146 until the notification of the end of printing from the printing control computer 400 is transmitted (step 148).

Figure 9:
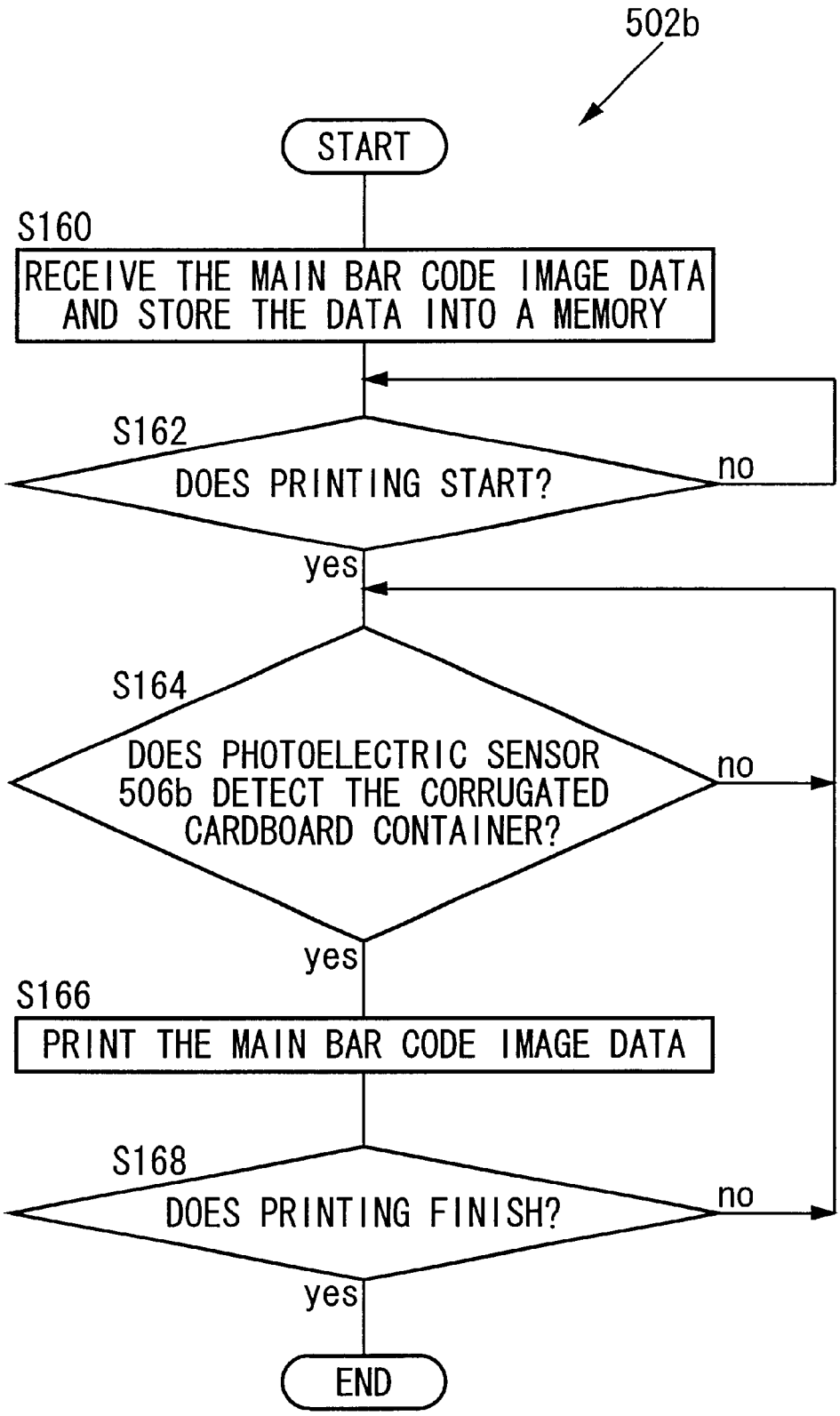
FIG. 9 is a flow chart showing the processing executed by the second controller when the printing system executes printing.

FIG. 9 is a flow chart showing the processing executed by the second controller 502*b* when the printing system 200 executes printing.

The second controller 502*b* receives, as described in FIG. 7, from the printing control computer 400 the main bar code data (step 160). Next, the second controller 502*b* waits for the order of the start of printing transmitted from the printing control computer 400 (step 162). When the order is sent, the second controller 502*b* watches if the photoelectric sensor 506*b* detects the corrugated fiberboard container (step 164). When an output signal from the photoelectric sensor 506*b* showing the corrugated fiberboard container 100 is detected, the second controller 502*b* executes the printing of the main bar code data. Here, the second controller 502*b* prompts, calculating the distance of the movement of the belt conveyer 304 using an output signal from the encoder 302, the second the print head 504*b* to print the main bar code data (step 166). The second controller 502*b* specifies the printing position using the output signal of the encoder 302 which directly reflects the moving distance of the belt conveyer 304. Thus, even in such case, for example, that the movement of the belt conveyer 304 includes pulsation and so on therefore is not constant, the system may print the bar code high in accuracy. The second controller 502*b* continues the processing of step 164 and the step 166 until the notification of the end of printing is sent from the printing control computer 400 (step 168).

Figure 10:
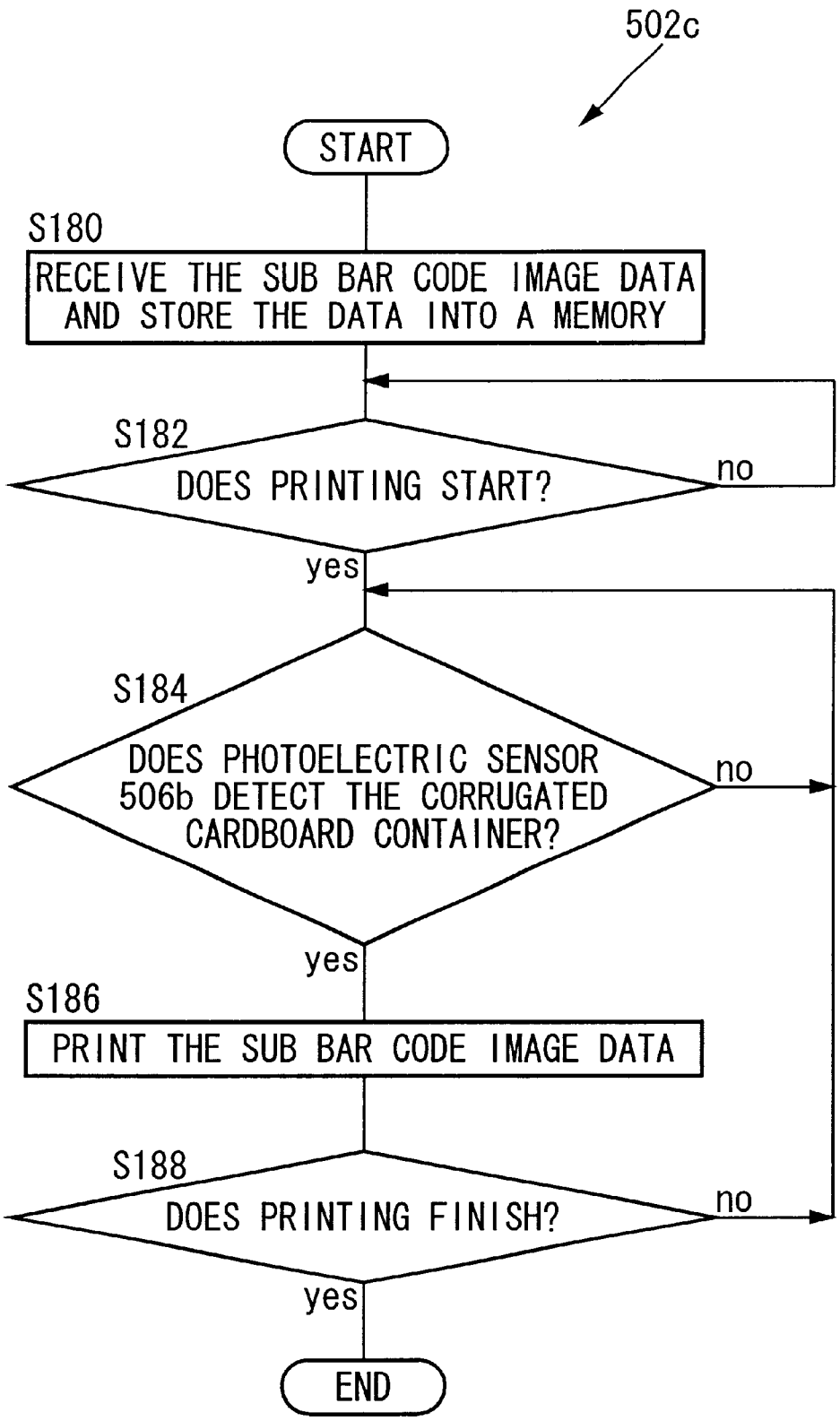
FIG. 10 is a flow chart showing the processing executed by the third controller when the printing system executes printing.

FIG. 10 is a flow chart showing the processing executed by the third controller 502*c* when the printing system 200 executes printing.

The third controller 502*c* receives, as described in FIG. 7, from the printing control computer 400 the sub bar code data (step 180). Next, the third controller 502*c* waits for the order of the start of printing transmitted from the printing control computer 400 (step 182). When the order is sent, the third controller 502*c* watches an output signal from the photoelectric sensor 506*b* inputted via the second controller 502*b* (step 184). When the photoelectric sensor 506*b* outputs the signal the corrugated fiberboard container 100 is detected, the third controller 502*c* prompts, calculating the distance of movement of the belt conveyer 304 using the internal clock, the third print head 504*c* to print the sub bar code data (step 186). The third controller 502*c* continues the processing of the step 184 and the step 186 until the notification of the end of printing is sent from the printing control computer 400 (step 188).

As described above, the second controller 502*b* and the third controller 502*c* detect that the corrugated fiberboard container 100 is conveyed to the predetermined position using the same output signal from the photoelectric sensor 506 *b*. Thus, using the same signal, even the bar code symbol is divided into the two regions and each of the regions are printed by two distinct print heads, the two regions are able to be printed without displacement in the present embodiment. Therefore, the bar code symbol may be printed by ink jet print heads without using an expensive high dot density type print head. The bar code symbol divided into the bar code region and the non-bar code region is printed by respective print heads included in the first print heads.

Figure 11:
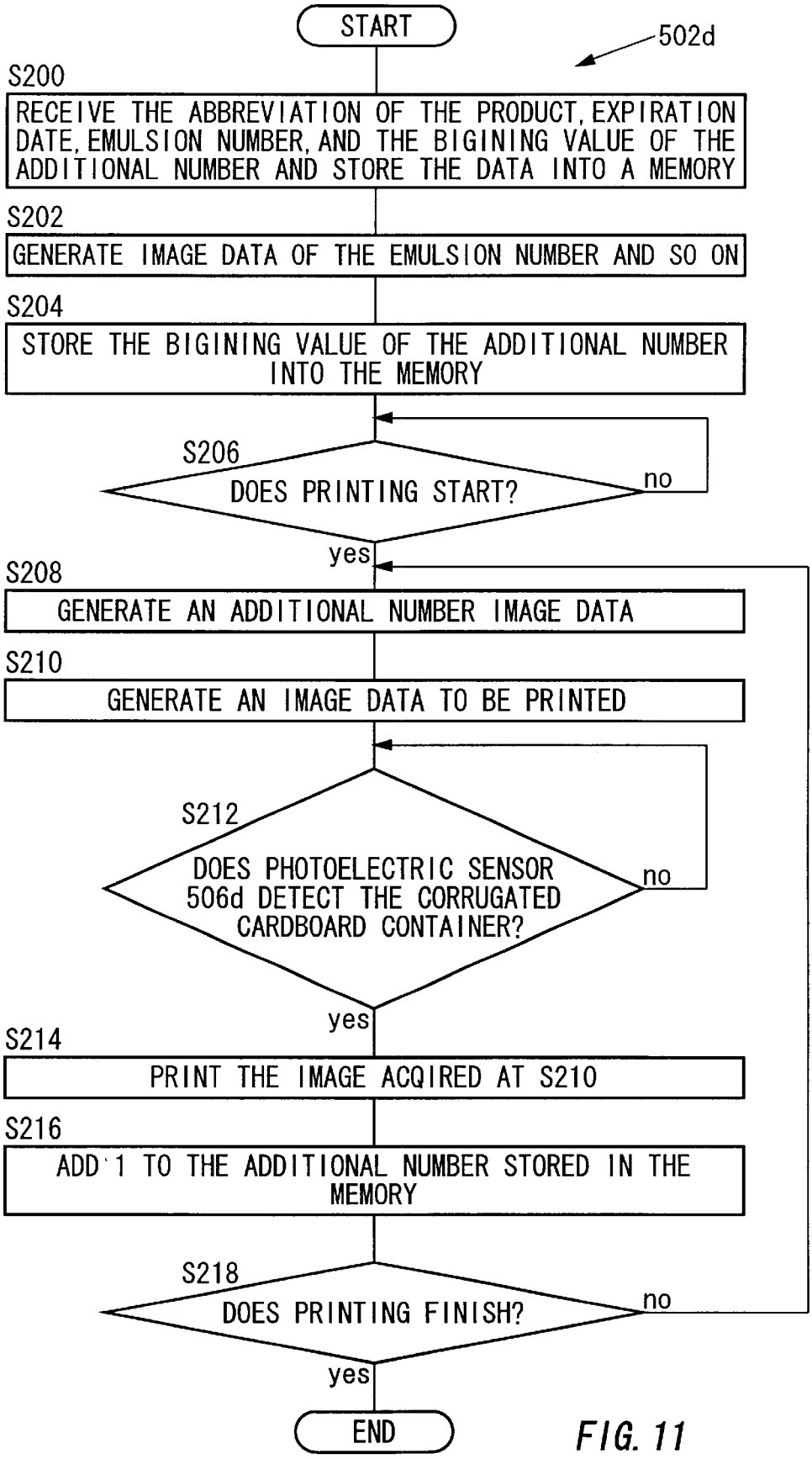
FIG. 11 is a flow chart showing the processing executed by the fourth controller when the printing system executes printing.

FIG. 11 is a flow chart showing the processing executed by the fourth controller 502*d* when the printing system 200 executes printing.

The fourth controller 502*d* receives, as described above, the abbreviation of the product, the expiration date, the emulsion number, and the beginning value to the additional number from the printing control computer 400 (step 200). The fourth controller 502*d* generates image data of the abbreviation of the product, the expiration date, and the emulsion number received from the printing control computer 400 (aforementioned "image data of the emulsion number and so on") (step 202). Next, the fourth controller 502*d* stores the beginning value to the additional number into a memory (step 204).

Next, the fourth controller 502*d* waits for the order of start of printing transmitted from the printing control computer 400 (step 206). When the order is sent, the fourth controller 502*d* generates an image data corresponding to the additional member, i.e. quantity of the packaging, stored in the memory (aforementioned "additional number image data")

(step 208). On the other hand, the fourth controller 502*d* superimposes the image data of the emulsion number and so on and the additional number image data so that generates an image data to be printed by the fourth print head 504*d* (step 210).

Then, the fourth controller 502*d* watches an output signal from the photoelectric sensor 506*d* (step 212). When the output signal from the photoelectric sensor 506*d* showing the corrugated fiberboard container 100 is detected, the fourth controller 502*d* executes printing of the image acquired in the step 210. That is, the fourth controller 502*d* prompts, calculating the distance of the movement of the belt conveyer 304 using the internal clock, the fourth print head 504*d* to print the image acquired in the step 210 (step 214). After the step 214 is finished, the fourth controller 502*d* adds 1 to the additional number stored in the memory for counting the quantity of the packaging (step 216).

The fourth controller 502*d* continues the processing from the step 208 through the step 216 until the notification of the end of printing from the printing control computer 400 (step 218).

As described above, the system according to the present embodiment prints information divided into a plurality of parts onto the corrugated fiberboard container using a plurality of ink jet print heads at least one of which is provided in different angle.

Applying the present embodiment, the bar code symbol is especially printed using the print heads of which the angle of the arraying direction of the ink jet nozzles with respect to the moving direction of the corrugated fiberboard container is smaller. The above described print heads may print in finer dot density, so that the bar code symbol maybe printed in such a high dot density that a printed part of the bar code symbol satisfies the optical characteristics defined by JIS.

Furthermore, applying the present embodiment, the product specifying information as the observed information is printed using the print heads the angle of the ink jet nozzles with respect to the moving direction of the corrugated fiberboard container is larger. The above described print heads are provided such status that the angle to the moving direction of the corrugated fiberboard container is larger, so that the print heads may print the larger sized characters for the size of print head. Furthermore, the above described print head prints characters in lower dot density, so that does not consume excessive ink by printing the product specifying information recognized only by the human therefore need less printing quality than the bar code symbol.

As a modification, for example, the bearer bar of the bar code symbol for the dispatch unit code is previously printed onto the corrugated fiberboard container 100 using the solid-printing, and the second and the third printing apparatuses print only the bar code or the bar code and the numeric characters situated on the position of the above described bearer bar.

Furthermore, in the above described embodiment, the bar code symbol corresponded to the dispatch unit code is generated by the printing control computer; however, the bar code symbol may be generated by the second controller and/or the third controller.

In other case, the target to be printed is not limited to the corrugated fiberboard container already assembled. The target to be printed may be, for example, a wrap round case before the assembly and so on. Furthermore, the material of the target to be printed is not limited to the corrugated fiberboard, but may be any material the ink jet print head printing is applied such as a carton paper and plastics and so on. Moreover, the target to be printed is not limited to a packaging.

In the above described embodiment, each of the print heads 504 is controlled by the corresponding controllers 502 at printing, though in some cases, the print head may be directly controlled by the control section 410 without being relayed by the controller 502 and prints the target.

Figure 12:
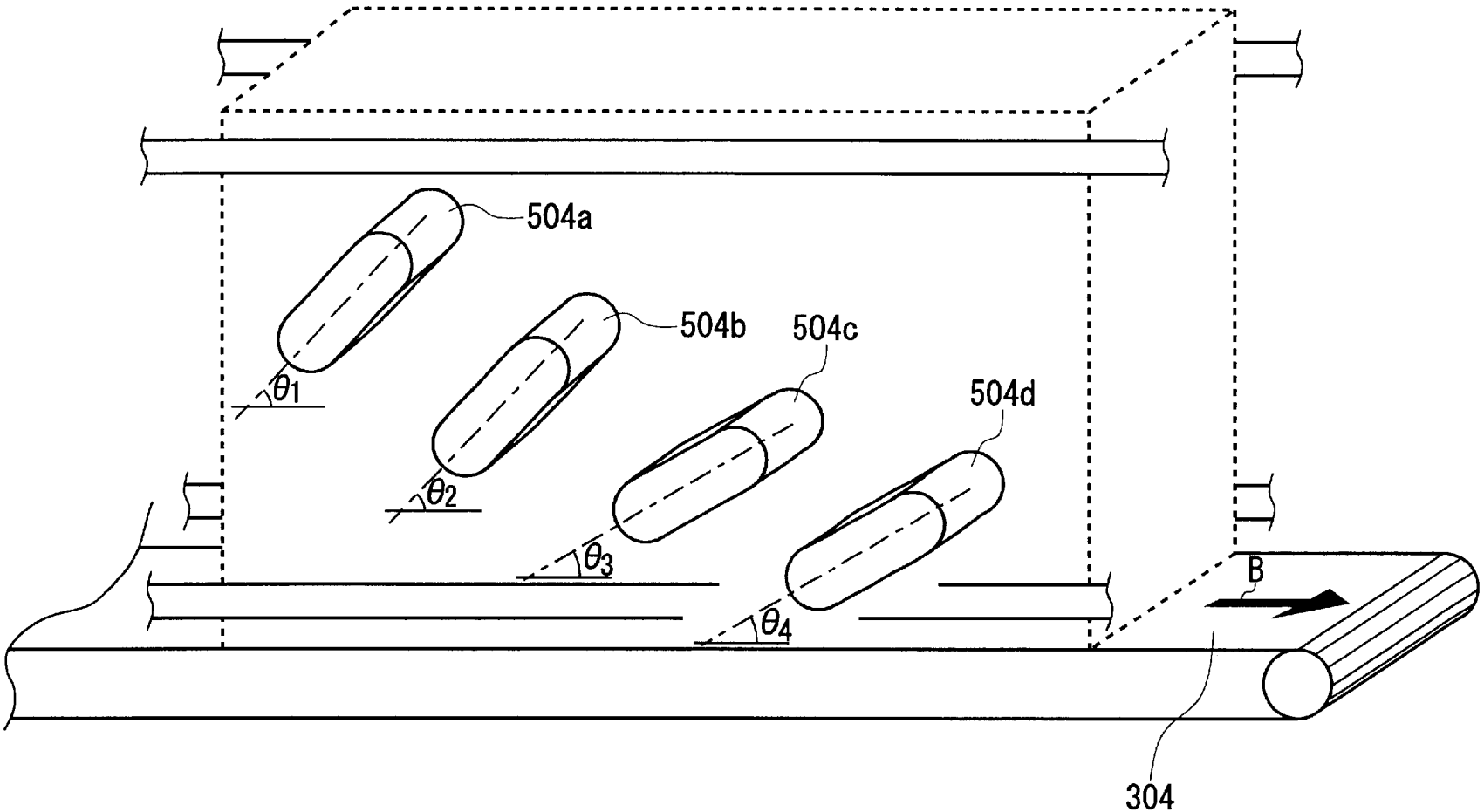
FIG. 12 shows a modification of the present embodiment of the present invention.

FIG. 12 shows another modification of the present embodiment of the present invention. For further modification of the present embodiment, at least one of the angles of the print heads is adjustable; so that the size and dot density of the printed region is selected each time an image to be printed is selected and set at the printing control computer corresponding to a demanded printing condition. Furthermore, a position of the bar code symbol on the material to be printed may be changed.

It is obvious from the description above, applying the present invention, a plurality of information of which printing conditions differ one another may be printed effectively and rapidly using the ink jet print heads.

Although the present invention has been described by way of exemplary embodiments, it should be understood that those skilled in the art might make many changes and substitutions without departing from the spirit and the scope of the present invention which is defined only by the appended claims.

What is claimed is:

1. A printing method for an ink jet printer to print first dot density information and second dot density information, comprising:

arranging a plurality of print heads including two or more first print heads to have a first angular orientation for printing said first information, and at least a second print head to have a second angular orientation, different from said first angular orientation for printing said second information;

printing said first information by said first print heads to obtain said first dot density; and printing said second information by said second print head to obtain said second dot density.

2. The printing methods as claimed in claim 1, further comprising:

moving material to be printed in a moving direction for printing the material with said first and second information, wherein each of said first print heads has a first angle with respect to said moving direction and said second print head has a second angle with respect to said moving direction, and said first angle is less than said second angle.

3. The printing methods as claimed in claim 1, wherein said first dot density is finer than said second dot density.

4. The printing method for an ink-jet printer as claimed in claim 1, wherein:

said first information is information recognized by an optical reading apparatus for distribution, and said information for the optical reading apparatus is printed by said first print heads in said first dot density that reflectivity in a printed part, which is printed by said first print heads, satisfies a predetermined value required by said optical reading apparatus.

5. The printing method for an ink-jet printer as claimed in claim 4, wherein:

a plurality of nozzles for ejecting ink droplets included in said first print heads is arranged in said first angle with respect to a direction in which a material to be printed is conveyed, and said first print heads print said information for the optical reading apparatus at such reflectivity in a printed part printed by said first print heads that exceeds a predetermined value required by said optical reading apparatus.

6. The printing method for an ink-jet printer as claimed in claim 4, wherein:

said second information is observed information, visually indicating type of a product accommodated in a package for a distribution on which said second and first information is printed, recognized by a person handling the packaging in the distribution, and said observed information is printed by said second print head, a plurality of nozzles included in said second print head is provided at said second angle for printing said observed information in a larger size than said first information.

7. The printing method for an ink-jet printer as claimed in claim 4, wherein:

said information for the optical reading apparatus is divided into more than one regions in the direction perpendicular to a direction in which material to be printed is conveyed, each of said regions are printed by respective print head included in said first print heads.

8. The printing method for an ink-jet printer as claimed in claim 4, wherein:

said information for the optical reading apparatus is a bar code symbol for a dispatch unit code system, said bar code symbol for the dispatch unit code system is divided into a bar code region including a bar code of the bar code symbol and a non-bar code region not including the bar code, and one of said first print heads prints said bar code region and another one of said first print heads prints said non-bar code region separately.

9. The printing method for an ink-jet printer as claimed in claim 4, wherein:

a bearer bar of a bar code symbol for a dispatch unit code is previously solid-printed on a material said first information and said second information is printed on, said information for the optical reading apparatus is a bar code included in the bar code symbol, and at least one of said first print heads prints, arranging said first print head is a position for printing said bar code, said bar code in said bearer bar.

10. A printing method for an ink-jet printer, comprising:

counting quantity of packaging being printed, acquiring a quantity symbol image corresponding to the quantity thus counted, acquiring a product information image providing information about the product accommodated in the packaging, superimposing said quantity symbol image and said product information image for generating an printing image to be printed on the packaging, and printing said printing image on the packaging using an ink jet print head.

11. A printing method for an ink jet printer, printing a bar code symbol for a dispatch unit code of a product on a packaging for distribution of the product, comprising dividing the bar code symbol into a bar code region including a bar code of the bar code symbol and a non-bar code region not including the bar code of the bar code symbol, and printing said bar code region and said non-bar code region separately using respective print heads.

12. The printing method for an ink-jet printer as claimed in claim 11, further comprising initially solid-printing a bearer bar of the bar code symbol on the packaging, and after said solid printing, printing a bar code of the bar code symbol in said bearer bar.

13. A packaging for accommodating a product for distribution, comprising:

information about the product for distribution printed on the packaging, said information being divided into first information and second information, wherein said first information is printed in a first dot density by a plurality of first ink jet print heads, and said second information is printed in a second dot density by at least a second ink jet print head.

14. The packaging accommodating a product as claimed in claim 13, wherein said first information is information recognized by the optical reading apparatus for distribution, and said information for the optical reading apparatus is printed in a predetermined dot density for satisfying reflectivity of a printed part, said reflectivity exceeding a predetermined value required by the optical reading apparatus.

15. A packaging for accommodating a product for distribution, comprising:

a bar code symbol of a dispatch unit code printed on the packaging, said bar code symbol having a bar code region including a bar code of said bar code symbol and a non-bar code region including the rest of said bar code symbol other than said bar code region, wherein: said bar code region and said non-bar code region are separately printed by respective ink-jet print heads.

16. The packaging for accommodating a product as claimed in claim 15, further comprising a previously solid-printed bearer bar.

17. A printing system for ink jet printing, comprising:

a plurality of first ink jet print heads for printing first information on material moved in a direction, each of said first print heads having a plurality of nozzles to have a first angle with respect to said moving direction for printing a predetermined dot density for being recognized by an optical reading apparatus for distribution; and a second ink jet print head for printing second information in a larger size than said first information, having a plurality of nozzles arranged to have a second angle with respect to said moving direction, different from said first angle.

18. The printing system for ink jet printing as claimed in claim 17, wherein:

at least one of said first angle and said second angle is adjustable for adjusting positions of said first information and said second information on a material to be printed for adjusting a position on a material to be printed of a bar code symbol for a dispatch unit code.

19. The printing system for ink jet printing as claimed in claim 17, wherein:

each of said first ink jet print heads and said second ink jet print head are structurally the same.

20. The printing system for ink jet printing as claimed in claim 19, wherein:

each of said first ink jet print heads and said second ink jet print head have a same number of ink jet nozzles.

21. The printing system for ink jet printing as claimed in claim 17, wherein:

said dot density satisfies a condition that reflectivity in a printed part, which is printed by said first ink jet print heads, exceeds a predetermined value required by an optical reading apparatus for distribution.

* * * * *